US005216971A

United States Patent [19]

Karmes

[11] Patent Number: 5,216,971

[45] Date of Patent: Jun. 8, 1993

[54] CATAMARAN RIGHTING APPARATUS

[76] Inventor: Roger A. Karmes, 150 Bridgewood Ave., North East, Md. 21901

[21] Appl. No.: 932,784

[22] Filed: Aug. 20, 1992

[51] Int. Cl.[5] ..... B63H 9/04

[52] U.S. Cl. ..... 114/39.1; 114/61; 114/91

[58] Field of Search ..... 114/39.1, 61, 90, 91, 114/102

[56] References Cited

U.S. PATENT DOCUMENTS

| | | | |
|---|---|---|---|
| 3,820,489 | 6/1974 | Wortmann | 114/39.1 |
| 3,865,061 | 2/1975 | Newman | 114/61 |
| 4,516,518 | 5/1985 | Cate | 114/39.1 |
| 4,651,666 | 3/1987 | Lake | 114/39.1 |
| 4,784,075 | 11/1988 | Segger | 114/61 |

OTHER PUBLICATIONS

Booklet—"If You Ever Wanted to Sail . . . Learn to Sail the Hobie Way"—pp. 4 & 20, Date etc. not known.

Booklet—"Using the UPRIGHT"—2 pages, Date etc. unknown.

*Primary Examiner*—Jesus D. Sotelo

*Attorney, Agent, or Firm*—Edward J. Kaliski

[57] ABSTRACT

An improved apparatus for righting an upset catamaran is disclosed. Apparatus are provided to apply and maintain a compressive force in the mast while extending the out-of-water permanent shroud so that a sailor standing on the in-water pontoon and pulling on a righting line fastened to the out-of-water pontoon can easily rotate the out-of-water pontoon over the vertical where gravity will add to the righting moment. The compressive force on the mast permits the shroud extension and resultant mast pivoting without risk of dismasting. Apparatus to limit the mast pivoting to a selected angle are also taught.

18 Claims, 6 Drawing Sheets

PRIOR ART

CATAMARAN RIGHTING APPARATUS

FIELD OF THE INVENTION

The invention relates to the field of sailing craft and more particularly to multi-hulled vessels such as catamarans and to apparatus to aid in righting such craft after an upset.

BACKGROUND OF THE INVENTION

A booklet entitled "If You Ever Wanted to Sail Learn To Sail The Hobie Way" supplied by the builder of the Hobie 16 and 18 catamarans, teaches the basic righting technique. A line, preferably one half inch in diameter and twenty feet long, is attached to the shroud on the out-of-water hull, or, if the boat has completely inverted, to the shroud on the windward hull. The crew stands on the other hull and pulls leaning back ("hiking") as much as possible. On the "18" a sailor can stand on the dagger board to gain mechanical advantage. Even with such small boats, however, a lone, and especially a light, sailor may not create an adequate turning moment and requires rescue by others.

A number of inventors therefore rely on means to provide greater righting force. Typical of these are the following:

Cate, U.S. Pat. No. 4,516,518 teaches use of a spar that on upset is fastened to the in-water hull and a tension line rigged from the other hull to the free end of the spar and down to a person in the water thus providing an extended moment arm.

Segger, in U.S. Pat. No. 4,784,518 employs a similar rig but has the spar permanently fastened at one end at or near the center of gravity of the boat which is under the mast mount.

Lake, U.S. Pat. No. 4,651,666 aids the crew by providing a water bucket that adds considerable weight to the pull on the righting line which may be rigged over a spar or spars.

A number of teachings exist in which the weight of the upper hull can be added to the weight of the crew by lengthening the out-of-water shroud. Known to the applicant are the following:

Wortmann, in U.S. Pat. No. 3,820,489, teaches provision of a shroud with a readily releasable lower end. A slack lanyard is permanently fastened to the shroud and to the hull. Releasing the lower end of the shroud elongates it by the length of the lanyard. This in turn frees the mast to tilt and permits that hull to be rotated over the top center without lifting the mast. Then a turning moment is provided by a sailor (or several sailors) standing on the lower hull (in-water hull) pulling on a righting line fastened to the upper (out-of-water) hull. Once over the center, the weight of the upper hull adds to the righting moment and raises the mast out of the water by the now taut, elongated shroud. The shroud is then shortened, if possible. It is difficult to do this without rigging some means to provide mechanical advantage. A major problem not addressed by Wortmann is the possibility of having the end of the mast come out of the socket of its mount when shroud tension is released.

A device called "THE UPRIGHT SOLO RIGHTING SYSTEM", available from Hobie Cat, PO Box 1008, Oceanside, CA 92054, appears to incorporate Wortmann's teachings. The releasable attachment is a ball lock pin. The device is sold in a kit which includes a "MAST KEEPER" which is a cable with end fittings that can hold the mast downward to the deck to reduce the chance of a dismasting when a shroud is lengthened.

In U.S. Pat. No. 3,865,061, Newman teaches righting apparatus for catamarans that provides a fixed length elongation of the shroud that runs to the upper, that is out-of-water, hull of a capsized boat. A lever is employed to do this or a cable, winch, and pulley combination is used to hold the shroud in the shorter, forward position and allow it to be lengthened. This in turn frees the mast to tilt and permits that hull to be rotated over the top center without lifting the mast. Then a turning moment is provided by a sailor, or several sailors, standing on the lower hull (in-water hull) pulling on a righting line fastened to the upper hull much as in Wortmann'procedure. Further, Newman's apparatus shifts the effective attachment point of the shroud a short distance aft to counter the pull of the foresail with the object of helping to keep the mast in the seat of its universal mount. This apparatus allows restoration of normal rigging with relative ease. Newman also teaches use of auxiliary means to aid in keeping the mast seated; a cable that is tethered to the deck or a short cable running through the mount from the base of the mast to a retention washer below.

None of the above art teaches or suggests the means provided by the instant invention to release a selected shroud to permit tilting the mast and to provide and maintain a temporary compressive force on the mast during the righting procedure thereby preventing dismasting and permitting easy restoration of the sailing rig.

SUMMARY OF THE INVENTION

The instant invention provides means to release a selected standing shroud and requires use of a righting line and a hiking procedure while standing on the in-water pontoon similar to the prior art but provides additional means that establishes and maintains a temporary compressive force on the mast during the righting procedure thereby preventing dismasting and permitting easy restoration of the sailing rig. This is accomplished by a system of blocks, lines and stops permanently installed below the trampoline or deck of a catamaran that acts selectively on permanently installed auxiliary shrouding that provides the force on the mast and allows tilting the mast away from the released shroud shortening the opposing shroud by a controlled amount.

DESCRIPTION OF THE PREFERRED EMBODIMENT

Figure 1:
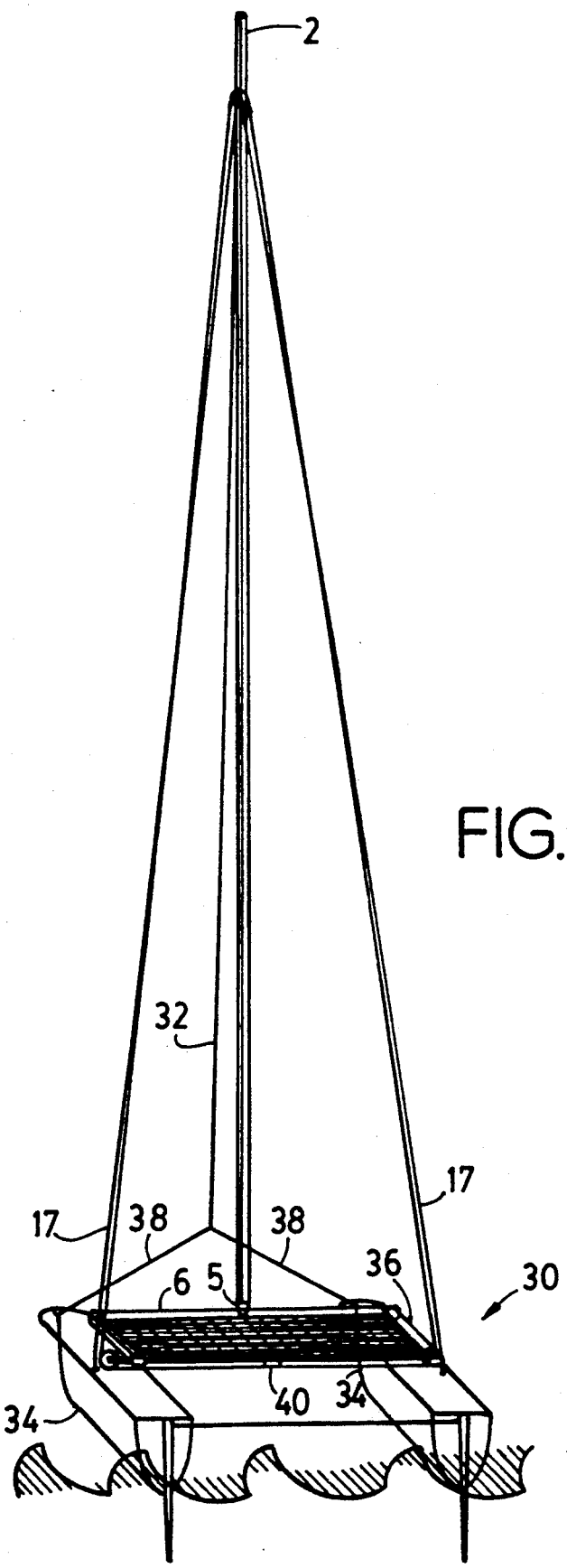
FIG. 1 is a somewhat schematic perspective view of a catamaran rigged with the subject invention.

FIG. 1 shows a vessel of the type known as a catamaran 30. This vessel comprises a mast 2, permanent shrouds 17, pontoons (hulls) 34, forestay 32 which is attached to pontoons 34 by bridel 38, trampoline 36 which spans the pontoons 34 and serves as a deck and at least one structural member 6 which joins the two pontoons 34 and provides support for a mast seat 5. Catamaran 30 is fitted with the righting gear 40 of the invention.

Figure 2:
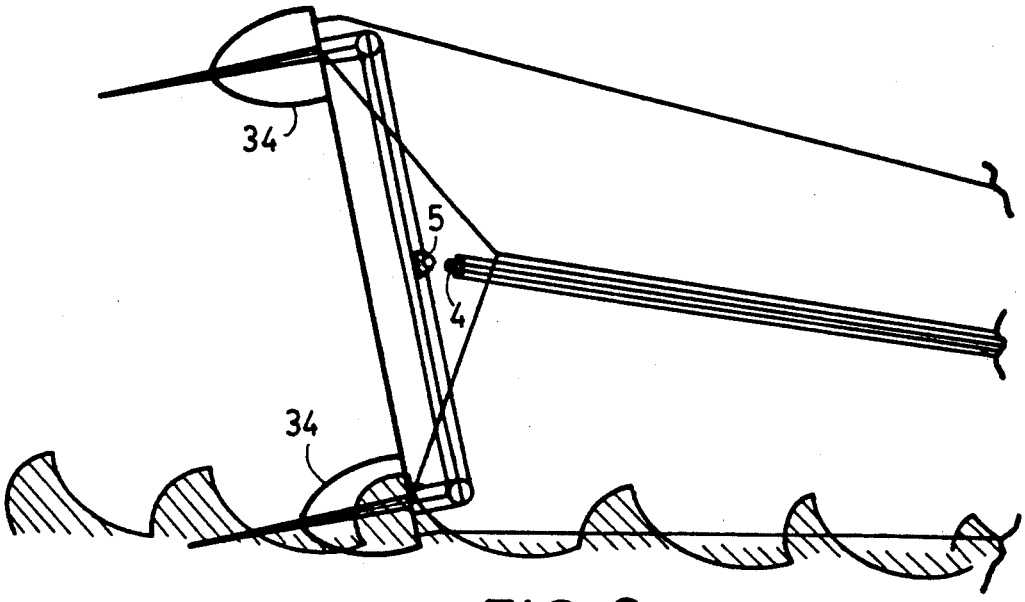
FIG. 2 is a side elevational view of an upset catamaran rigged with righting gear according to the prior art.
Figure 3:
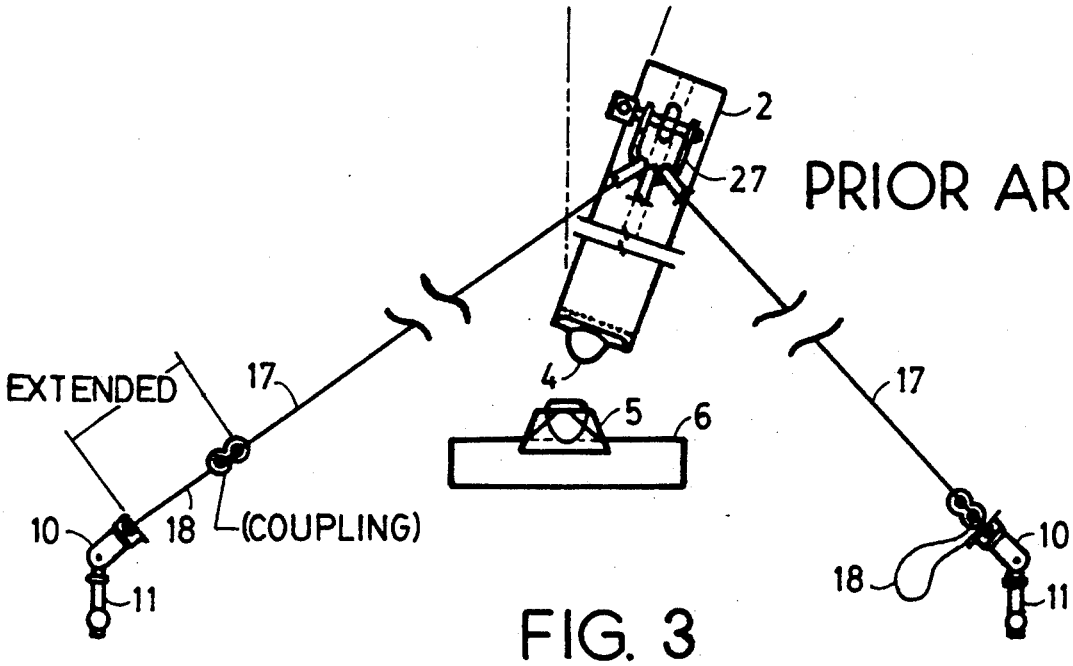
FIG. 3 is a detailed view of the mast and rigging of an upset catamaran fitted according to the prior art for righting.

Consider now a catamaran 30 which has suffered an upset. Usually the boat assumes the position shown in FIG. 4 with the head of mast 2 submerged and one pontoon 34 floating and the other in the air and swung past a vertical line from the floating pontoon. Also consider the use of the righting gear of the prior art of Wortmann or the "UPRIGHT SOLO RIGHTING SYSTEM" described previously. See FIGS. 2 and 3. Permanent shroud 17 is uncoupled from deck fitting 10 which is fastened to a pontoon 34 by anchor bar 11. This is done by removing a releasable pin not shown. A permanently installed, and previously slack, extension 18 then allows the shroud to lengthen. It is possible at this point for a sailor to fasten a righting line not shown to the out-of-water pontoon 34 and stand on the in-water pontoon 34 while pulling on the righting line to right the boat. The weight and pull, if sufficient, create a moment that rotates the upper pontoon 34 over top center as mast 2 pivots relative to the plane of the pontoons 34 to a configuration such as that of FIG. 5 where gravity acting on the out-of-water pontoon 34 and the force on the righting line returns the boat to the upright position. Unfortunately, and this is the defect of the prior art referred to previously, mast 2 can easily become unseated as seen in FIGS. 2 and 3 because the restraint on mast base 4 out of mast seat 5 has been removed. Dismasting usually cannot be corrected in the water, even with the help of others.

Figure 4:
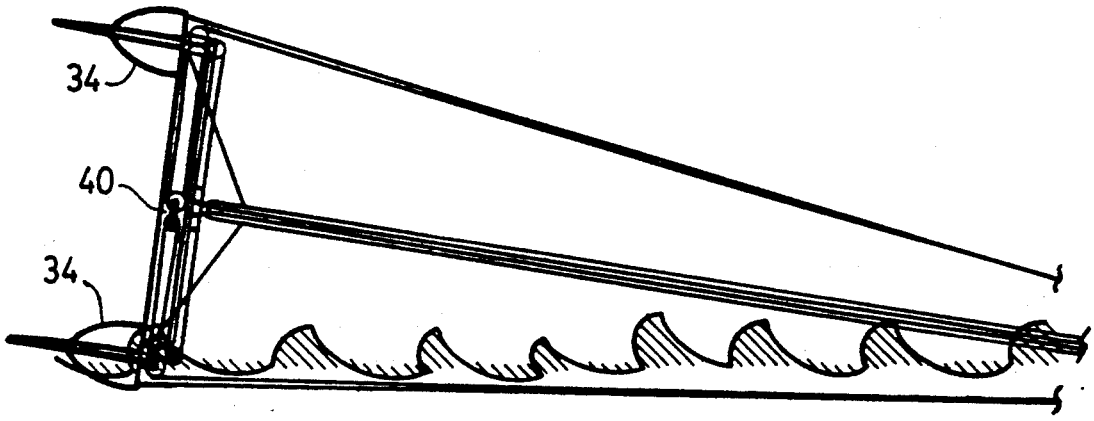
FIG. 4 is a side elevational view of an upset catamaran rigged with righting gear according to the instant invention shown before actuating the righting gear.
Figure 5:
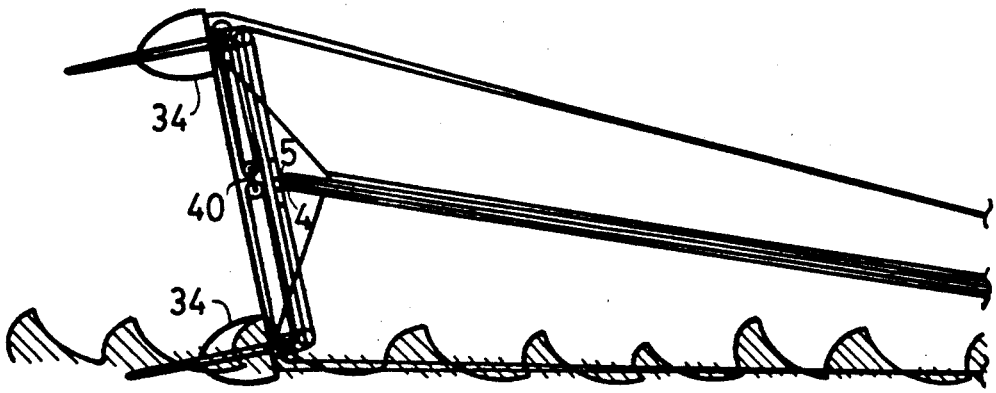
FIG. 5 is a side elevational view of an upset catamaran rigged with righting gear according to the instant invention shown after actuating the righting gear.

With the righting apparatus 40 of the invention, a catamaran 30 may be upset as shown in FIG. 4 and a single sailor by actuating righting gear 40 can lengthen the out-of-water shroud 17 and put a compressive force on mast 2 that retains mast base 4 in mast seat 5 to attain the configuration of FIG. 5. Then pulling on a righting line while standing on the in-water pontoon 34 will right the boat and the mast will not be unseated.

Figure 6A:
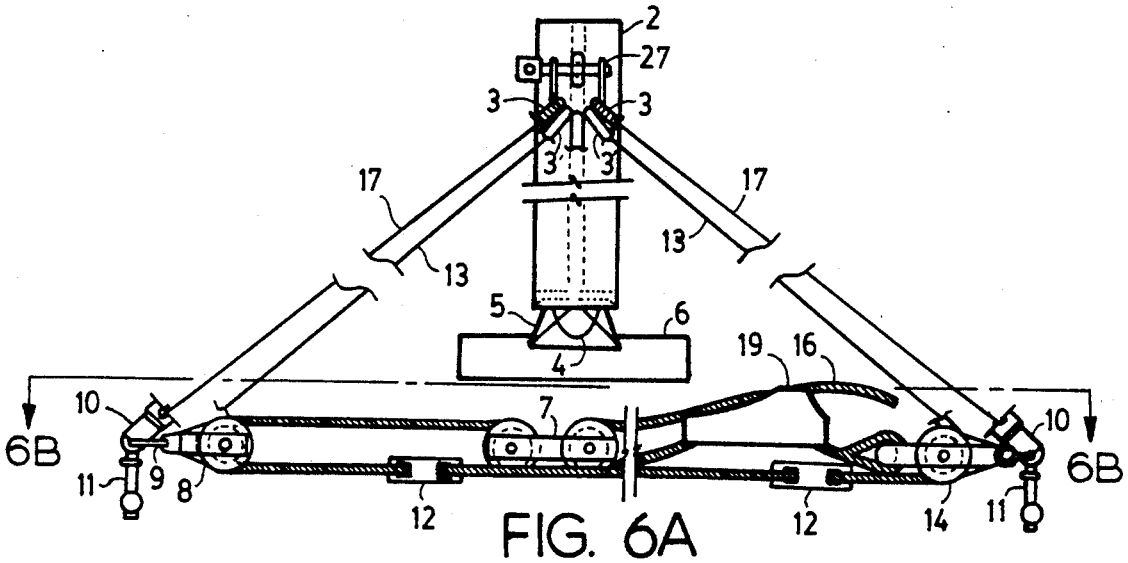
FIG. 6A is an elevational view in detail of the righting gear of the invention shown rigged for normal sailing.
Figure 6B:
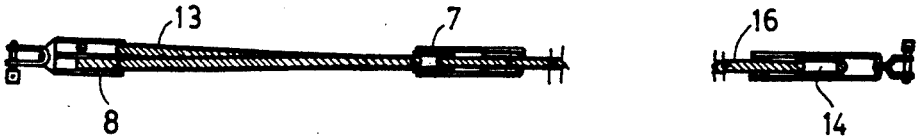
FIG. 6B is a partial top view of the portion of the righting gear seen in the cross-section taken on the line 6B—6B of FIG. 6A.
Figure 7A:
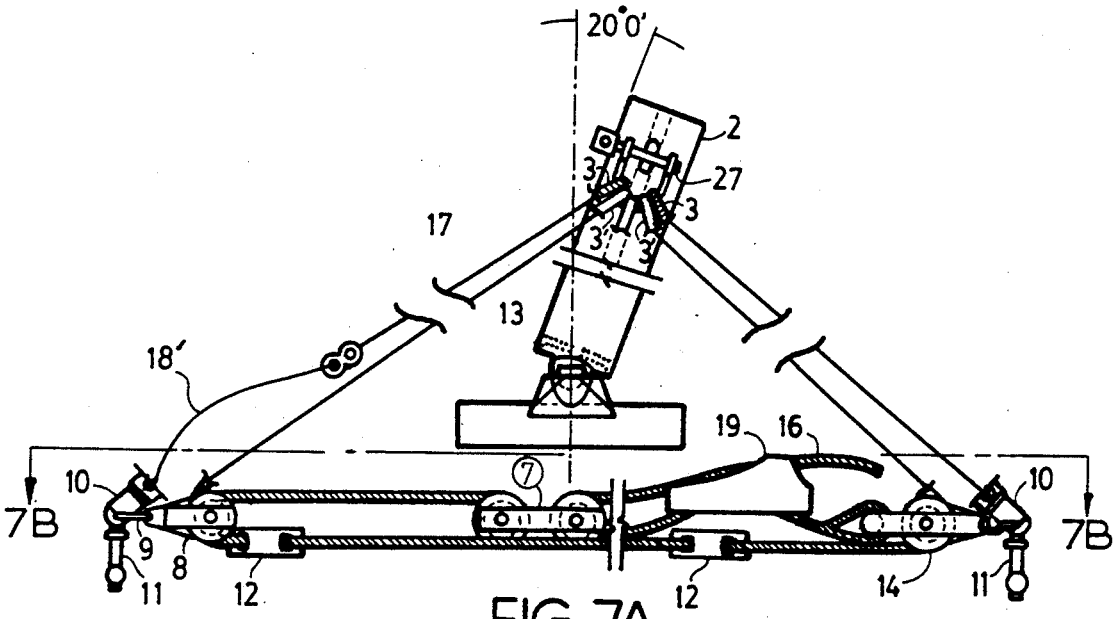
FIG. 7A is an elevational view in detail of the righting gear of the invention shown actuated after an upset.
Figure 7B:
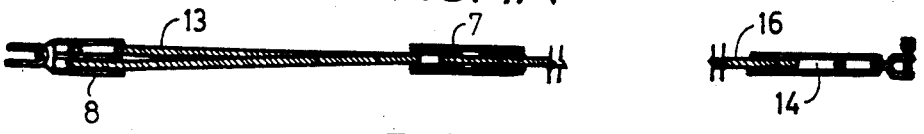
FIG. 7B is a partial top view of the portion of the righting gear seen in the cross-section taken on the line 7B—7B of FIG. 7A.
Figure 8:
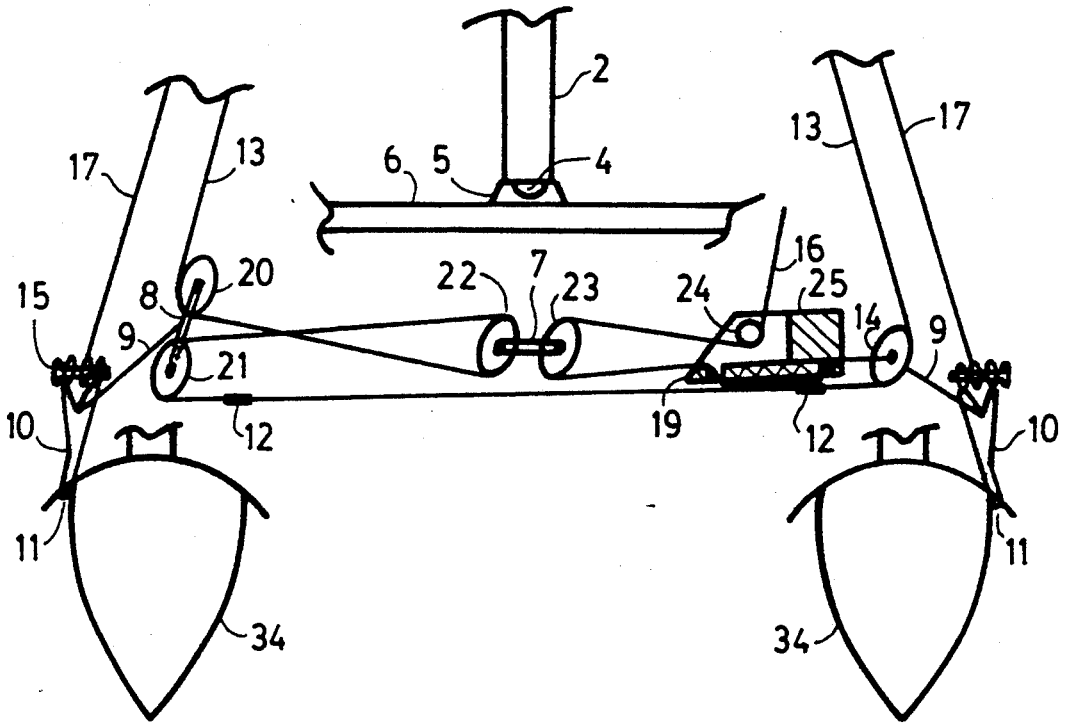
FIG. 8 is a schematic view of the righting gear of the invention.

The details of the righting gear 40 are seen by reference to FIG. 6, which shows the rig under sailing conditions; FIG. 7, which shows the rigging with the mast 2 tilted about 20 degrees which is the preferred maximum; and to FIG. 8, which is a schematic of the system. A permanent shroud 17 is released as in the prior art and the loose end is retained by a lanyard 18' similar to the prior art but without the load bearing capability of extension 18. Auxiliary shrouds 13 are in fact preferably a single, continuous length of DACRON TM (DACRON is the trademarked name of the polyester fiber produced by E. I. Du Pont de Nemours and Company of Wilmington DE 19898) cordage that is run from shackle 27 near the mast head to first block 8, which is attached to deck fitting 10 by link 9. Block 8 has two sheaves that are side by side, Shroud 13 passes over the first such sheave 20 to the first sheave 22 of block 7, which has two sheaves in tandem, and back to the second sheave 21 of block 8 to block 14, a single sheaved block which is fastened to the other deck fitting 10, and then to Shackle 27. Between blocks 8 and 14 are two stops 12 which are placed to limit pivoting the mast more than 20 degrees on either side of vertical by the wedging of a stop 12 into block 8 or 14 in the absence of restraint from a permanent shroud 17. Stops 12 preferably are figure eight knots. Other knots are workable. It is also practicable to divide auxiliary shroud 13 into two shrouds each ending in an eye which acts as a stop there being an interconnecting line between the two eyes.

Essential to the invention is a means to induce tension in auxiliary shroud 13 before releasing and extending one of the permanent shrouds 17. A person of ordinary skill can contemplate a number of such means which should be considered equivalents of the preferred embodiment illustrated and to be described. A tensioning line 16 is fastened to block 14 (which is the equivalent of fixing the end of the line to the closest pontoon). At a convenient location along line 16 a jam cleat 19 is fixed. In the preferred embodiment, this is a CL 236 Jam Cleat made by CLAMCLEAT of England which has been modified by opening up and rounding the edges of the mounting holes in the bottom so that line 16 can be brought inside, down through one mounting hole and up through the next and out the end in effect jamming the jam cleat onto line 16. Line 16 then is passed over the second sheave 23 of tandem block 7 and back into cleat 19 and over sheave 24 for tightening or into jam section 25 for holding.

In use, after capsizing the sailor first points the mast into the wind, by holding and moving the tip of the mast. The auxiliary shrouds 13 are put into tension to put mast 2 into compression as has been discussed. The sailor releases the end of tensioning line 16 which has been tied off at some convenient point, not shown; pulls hard over sheave 24 to create the needed tension; and locks it into the system by putting the end of line 16 into the jam section 25. Then he or she releases the out-of-water shroud 17 by pulling the releasable pin 15 that holds it to the deck fitting. Such a pin should be attached to a lanyard, not shown, so that it will not be lost as should be released standing shroud. Then, as in the prior art, a righting line is attached to the out-of-water pontoon 34 and the sailor stands on the in-water pontoon 34. Pulling on the righting line will rotate the hull and trampoline assembly so that the upper hull (pontoon) goes over the vertical centerline while the auxiliary shroud 13 slips through the system of blocks until the higher stop 12 wedges in either block 8 or 14 depending on which side the boat rests. Further pulling on the righting line, assisted by the weight of the upper pontoon, rights the boat.

Before sailing again, it is plain, the lengthened, permanent shroud 17 must be shortened. This is done in one of several ways:

1) Replace the fixed stops 12 with movable stops. The modified CL 236 CAMCLEATs, mentioned above, work well for this purpose. Position the mast in its normal (vertical-when the boat is upright) position and hold it there by pulling on the disconnected permanent shroud. Slide the movable stop nearest the hull from which the permanent shroud was disconnected toward block 8 or 14 as applies. Jamming the CLAMCLEAT against the appropriate block will hold the mast in the "vertical" position while the permanent shroud is reconnected.

2) The auxiliary shrouds of the instant invention form in fact one continuous loop from the mast head to one hull, to the other hull, and back to the mast head with means to tension and detension same. Therefore any device which will controllably allow the auxiliary shrouds to travel in one direction but not the other such as a CLAMCLEAT or other jam cleat etc. (in which the auxiliary shroud can be clamped at will) will hold the mast in the vertical position once it is placed there allowing the sailor to reconnect the permanent shroud lines.

3) A line attached to the lower end of the disconnected shroud which passes through an additional sheave on block 8, or 14 as appropriate, will provide mechanical advantage to position and hold the mast while the permanent shroud is reconnected.

Sometimes a boat of this type will capsize and turn turtle. That is to say the boat has completely inverted and the mast is vertical below the boat. Then it is necessary that the sailor take steps to return the boat to the more common configuration of the figures where the mast is close to horizontal. The righting system of this invention is of value in this situation. By tilting the mast to one side with respect to the hull-trampoline assembly while preventing dismasting, the configuration assists greatly the effort to place the mast in a horizontal position prior to righting.

It should be noted that the figures show the auxiliary shrouds 13 rigged inboard of the permanent shrouds 17. In this configuration the thimbles 3 are in contact as shown in FIG. 6. Because we use auxiliary shrouds 13 made of DACRON, the thimbles 3 are made of plastic whereas the thimbles 3' on the wire permanent shrouds 17 are metal. This combination has been found to lead to crushed and chafed plastic thimbles. To avoid this crushing, it is possible to fasten the plastic thimbles 3 to shackle 27 by extension links. Carabiners, as used in mountain climbing, serve the extension function well. The auxiliary shrouds 13 may also be rigged outboard at shackle 27 crossing the permanent shrouds 17 nearby thus avoiding crushing and chafing of the plastic thimbles 3'. This configuration is not shown in the drawings but is a practicable choice for rigging the shrouds of this invention.

I claim:

1. For use with a multi-hulled vessel such as a catamaran comprising:

a vessel with two outboard pontoons rigidly connected by a support structure and associated trampoline or deck; a mast having a head and a foot, said foot held in a seat on said support structure;

a forestay connecting said mast to said pontoons said forestay fastened to said mast generally in the region of said mast head and to said pontoons generally in the region of the bow;

at least one shroud athwart said mast on each side connecting said mast to each of said pontoons, each said at least one shroud fastened to said mast generally in the region of said mast head, and each releasably fastened to an anchor on an outboard pontoon;

said forestay and said shrouds being without applied tension but of selected lengths such that any motion of the mast tensions at least one of said stay or shrouds and a compressive force is created in said mast, said compressive force in said mast holding said foot in a seat mounted on said supporting structure;

righting apparatus comprising:

an auxiliary shroud of a length selected to run from a fastening in the region of the head of said mast to a first one of said pontoons where it is runningly fastened and thence to the second one of said pontoons where it is runningly fastened and thence to a second fastening in the region of said mast head with means to limit the run thereof to limit the tilt of said mast a selected amount and means to selectively apply tension within the righting apparatus such that upon selective release of a shroud said mast can be tilted athwartship away from said released shroud while said auxiliary shroud provides and maintains a compressive force in said mast;

whereby in an upset with said catamaran lying with part of said mast and one said pontoon in the water and the other said pontoon out of the water, said pontoon out of the water can be moved above or beyond the vertical relative to said pontoon in the water by a righting force or moment applied to said pontoon out of the water such that a weight applied to said pontoon in the water as by a person standing thereon and/or a further righting force or moment applied to said pontoon out of the water readily rights said catamaran without dismasting.

2. The righting apparatus of claim 1 wherein the tilt of said mast on either side of vertical is limited to twenty degrees.

3. The righting apparatus of claim 1 wherein the auxiliary shroud is runningly attached to said first pontoon by a first double block running over the first sheave thereof to the first sheave of a double block intermediate said first and second pontoons and thence returning to the second sheave of said first double block and thence to said second pontoon there being runningly attached by a single block and wherein the means to selectively apply tension is a tension line fastened to said single block and passing over the second sheave of said intermediate double block and returning to a jam cleat fastened to said tension line intermediate said single block and said intermediate double block.

4. The righting apparatus of claim 3 wherein the means to limit the run of said auxiliary shroud are two stops placed on said auxiliary shroud intermediate said first double block and said single block and located such that said stops can wedge in the sheaves of said blocks to limit the run.

5. The righting apparatus of claim 4 wherein the stops are knots formed in said auxiliary shroud.

6. The righting apparatus of claim 3 wherein the intermediate double block is a tandem block.

7. The righting apparatus of claim 3 wherein the jam cleat has a sheave over which said tension line can be passed to facilitate applying tension prior to insertion of said tension line into said jam cleat for retention therein.

8. The apparatus of claim 1 wherein the auxiliary shroud is DACRON cordage.

9. The apparatus of claim 1 wherein the released end of a shroud when selectively released is constrained by a lanyard to remain in the vicinity of said anchor without limiting said selected tilt of the mast.

10. Righting apparatus for multi-hulled vessels such as catamarans comprising:

a vessel with two outboard pontoons rigidly connected by a support structure and associated trampoline; a mast having a head and a foot;

a forestay connecting said mast to said pontoons said forestay fastened to said mast generally in the region of said mast head;

at least one shroud athwart said mast on each side connecting said mast to each of said pontoons, each said at least one shroud fastened to said mast generally in the region of said mast head, and each releasably fastened to an anchor on one of said outboard pontoons;

said forestay and said shrouds being without applied tension but of selected lengths such that any motion of the mast tensions at least one of said stay or shrouds and a compressive force is created in said mast; said compressive force in said mast holding said foot in a seat mounted on said supporting structure; and said righting apparatus comprising two auxiliary shrouds, one said auxiliary shroud athwart said mast on each side, each fastened generally in the region of said mast head and each runningly fastened to the outboard pontoon on the side on which said auxiliary shroud runs, said auxiliary shrouds being interconnected in the general region of said pontoons with means to limit the run thereof to a selected tilt of said mast and means to selectively apply tension within the righting assembly such that upon selective release of a shroud said mast can be tilted athwartship away from said released shroud while said auxiliary shrouds maintain a compressive force in said mast sufficient to retain said mast foot in said seat, said tilt being constrained to a selected amount by said run limiting means;

whereby in an upset with said catamaran lying with part of said mast and one said pontoon in the water and the other said pontoon out of the water, said pontoon out of the water is moved above or beyond the vertical relative to said pontoon in the water such that a weight applied to said pontoon in the water as by a person standing thereon and/or a force or righting moment applied to said connected pontoon readily rights said catamaran without dismasting.

11. The righting apparatus of claim 10 wherein the tilt of said mast on either side of vertical is limited to twenty degrees.

12. The righting apparatus of claim 10 wherein the auxiliary shrouds are runningly attached to said first pontoon by a first double block running over the first sheave thereof to a junction with said interconnection and thence to the first sheave of a double block intermediate said first and second pontoons and thence returning to the second sheave of said first double block and thence to a junction with said second auxiliary shroud and thence to said second pontoon there being runningly attached by a single block and wherein the means to selectively apply tension is a tension line fastened to said single block and passing over the second sheave of said intermediate double block and returning to a jam cleat fastened to said tension line intermediate said single block and said intermediate double block.

13. The righting apparatus of claim 12 wherein the means to limit the run of said auxiliary shroud are stops placed on said auxiliary shroud intermediate said first double block and said single block and located such that said stops can wedge in the sheaves of said blocks to limit the run.

14. The righting apparatus of claim 12 wherein the stops are the junctions between said shrouds and said interconnection.

15. The righting apparatus of claim 12 wherein the intermediate double block is a tandem block.

16. The righting apparatus of claim 12 wherein the jam cleat has a sheave over which said tension line can be passed to facilitate applying tension prior to insertion of said tension line into said jam cleat for retention therein.

17. The apparatus of claim 12 wherein the auxiliary shrouds are DACRON cordage.

18. The apparatus of claim 12 wherein the released end of a shroud when selectively released is constrained by a lanyard to remain in the vicinity of said anchor without limiting said selected tilt of the mast.

* * * * *